United States Patent [19]

Stokoe

[11] Patent Number: 4,569,416

[45] Date of Patent: Feb. 11, 1986

[54] ACCESS EQUIPMENT

[75] Inventor: Ridley Stokoe, Whitley Bay, England

[73] Assignee: Aerial Access Equipment Limited, United Kingdom

[21] Appl. No.: 579,884

[22] PCT Filed: Jun. 7, 1983

[86] PCT No.: PCT/GB83/00150

§ 371 Date: Feb. 6, 1984

§ 102(e) Date: Feb. 6, 1984

[87] PCT Pub. No.: WO83/04406

PCT Pub. Date: Dec. 22, 1983

[30] Foreign Application Priority Data

Jun. 9, 1982 [GB] United Kingdom ..... 8216668

[51] Int. Cl.[4] ..... B66F 11/04

[52] U.S. Cl. ..... 182/2; 182/63

[58] Field of Search ..... 182/2, 63, 62.5, 17

[56] References Cited

U.S. PATENT DOCUMENTS 2,787,278 4/1957 Mitchell ..... 182/2
3,485,321 12/1969 Smith ..... 182/63
4,194,591 3/1980 Fisher ..... 182/17
4,360,077 11/1982 Abbott ..... 182/2

FOREIGN PATENT DOCUMENTS 47109 5/1889 Fed. Rep. of Germany ..... 182/63
1520632 8/1978 United Kingdom .

*Primary Examiner*—Reinaldo P. Machado
*Assistant Examiner*—Alvin Chin-Shue
*Attorney, Agent, or Firm*—Ross, Ross & Flavin

[57] ABSTRACT

Access equipment comprising an articulated boom arrangement for supporting a cage, in which a lower boom and upper boom are pivotally connected and the lower boom is pivoted to a turntable platform boom relatively to the lower boom and a second ram for moving the lower boom relatively to the platform. With a view of avoiding the need to provide complex control gear, movement of the lower boom under the control of its ram is limited so that, in its rest position, the lower boom is arranged to extend upwardly with respect to the platform at an angle $\theta$ such that, in operation, the booms are not movable into positions in which the equipment becomes unstable.

4 Claims, 6 Drawing Figures

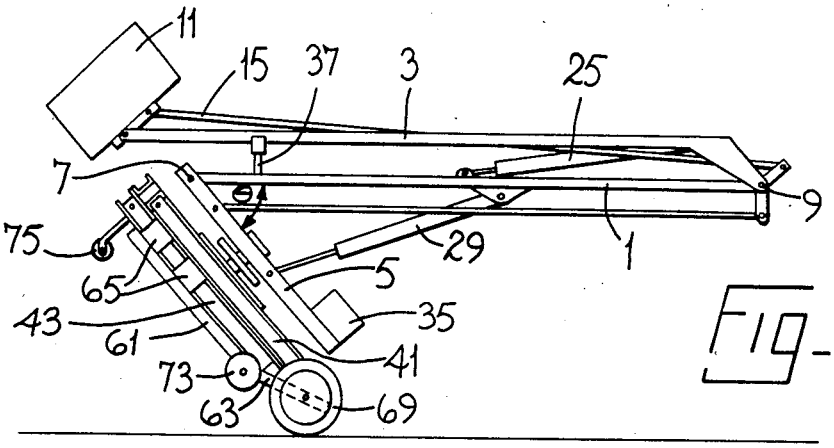
Fig. 3
Fig. 4
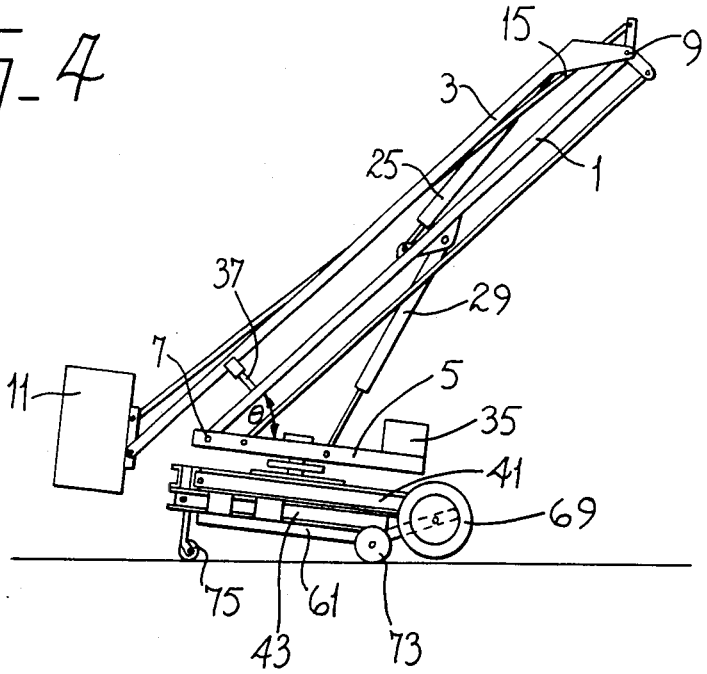

ACCESS EQUIPMENT

TECHNICAL FIELD

This invention is concerned with access equipment comprising a working platform or cage carried at a free end portion of a boom assembly which comprises a first boom pivotally mounted at one end portion on a support structure for movement about a first horizontal pivot and a second boom pivotally connected at one end with the free end portion of the first boom for pivotal movement about a second horizontal pivot, the working platform being pivotally supported at the free end portion of the second boom, separate power operated means, in the form of hydraulic rams, being provided for moving the two booms about the first and second horizontal pivots. Conveniently, the support structure includes a turntable mounted on a mobile platform for rotation about a vertical axis. The mobile platform may comprise either a self-propelled vehicle or a separately towable trailer.

BACKGROUND ART

In known kinds of access equipment of the kind under consideration it is usually necessary to provide fairly complex control equipment incorporating limit switches and valve arrangements whereby the required safety requirements may be met to avoid such sequences of movement of the booms which would cause the cage to be moved into positions where the equipment would become unstable. Furthermore known kinds of access equipment are usually fairly large and heavily constructed and are consequently expensive to manufacture.

The invention is concerned with the production of a relatively light-weight, simple and easily manufactured access equipment which has simple control gear and is of such a size it is particularly suitable for use by Do-it-yourself handimen and the like, is easily manoeuvered, and is towable by a domestic car.

DISCLOSURE OF INVENTION

According to the invention access equipment comprises an articulated boom arrangement for supporting a working platform or cage and comprising upper and lower booms, the lower boom being pivoted at one end portion to a turntable platform rotatable about a heightwise axis with respect to a trolley portion, the other end portion of the lower boom being pivotally connected to one end portion of the upper boom, the other end portion of which carries the working platform or cage, a first ram for moving the upper boom about its pivotal connection with the lower boom and a second ram for moving the lower boom about its pivotal connection with the turntable, characterized in that means is provided for limiting the movement of the lower boom under control of said second ram in such a way that, in its rest position, the lower boom is arranged to extend upwardly with respect to the turntable platform at an angle $\theta$ such that, in operation, the booms are not movable into positions in which the equipment becomes unstable.

Preferably, in access equipment as set out in the previous paragraph, the rest position of the lower boom is determined by the instroked position of the second ram. Similarly the limits of the positions to which the upper boom can be swung relatively to the lower boom are also conveniently limited by the stroke of the second ram and its size and positions of connection with the two booms. By way of example only, a suitable length of lower boom (having the above mentioned desiderata in mind) may conveniently be of the order of from about 2.75 m to 3 m, and the upper boom slightly longer so that, when the lower boom is in its rest position at the angle $\theta$ above referred to, the upper boom (in its rest position) extends downwardly at least substantially parallel to the lower boom to position the cage near the ground for easy access. Conveniently, the angle $\theta$ will be in the range of from 45° to 55° preferably in the range of 50° to 52° to the horizontal.

With a view to providing for ease of manoeuvering, the trolley portion of access equipment in accordance with the invention is provided with a first pair of wheels on which the equipment may be towed, with the boom arrangement in a more or less horizontal position but inclined to the turntable platform at said angle $\theta$, by means of a domestic car, the equipment being hitched up by any convenient means such as a hook arrangement provided on the lower boom. The trolley portion also is provided with a pair of auxiliary wheels spaced somewhat therefrom along the length of the trolley portion, the construction and arrangement being such that, on arrival on site the equipment may be unhitched from the towing vehicle and wheeled to working position whereupon the operator may, by pushing upwardly on the lower boom, tilt the equipment about the first pair of wheels (the road wheels) until it reaches a jacking position in which it rests upon the auxiliary wheels in addition to the road wheels. The equipment may still be manoeuvered in this condition. The equipment may then be jacked up and levelled, by means of jacking arrangements on outrigger arms pivotally connected with the trolley portion, the outrigger arms being lockable in inoperative or in operative positions. By providing a plurality of positions in which the outrigger arms can be locked the levelling of the equipment on level or sloping ground is facilitated. Furthermore by making provision for the outrigger arms to be locked in substantially upright positions it is possible to use the equipment in relatively confined spaces, since the jacks (or some of them) may then be caused to engage walls of adjacent buildings.

In the operation of equipment in accordance with the invention, the cage is moved to various working positions chiefly by operation of the second ram swinging the upper boom relatively to the lower boom, it being understood that movement of the lower boom about its pivotal connection with the turntable platform (to the limited extent permitted by the stroke of the first ram) mainly affects the outreach of the cage. Operation of the rams may be effected by simple switch gear provided at the cage controlling a power unit mounted at an end portion of the turntable platform. Similarly, slewing movements may be controlled from the cage, through means comprising a worm rotatably mounted on the turntable platform meshing with a helical gear secured to the trolley portion, and rotation of the worm being effected either through a system of shafts rotatably mounted in bearings mounted on the booms and interconnected by means including flexible drives, or by a remotely controlled electric motor.

With a view to keeping the manufacturing costs to a suitable low level access equipment in accordance with the invention may be constructed using simple manufacturing techniques from readily available stock materials.

For example, the trolley portion may be fabricated from lengths of steel channel members welded together. Similarly steel channel members and welding techniques may be used in manufacturing the booms. Readily available components may be used for the simple pivotal connections between the boom members, the cage, the turntable platform, the rams and the trolley portion.

There will now be given, with reference to the accompanying drawings, a more detailed description of an illustrative embodiment of the invention. It is, however, to be clearly understood that the illustrative embodiment is selected for description merely by way of exemplification of the invention and not by way of limitation thereof.

BRIEF DESCRIPTION OF DRAWINGS

In the accompanying drawings:

FIG. 3 is a side elevational view of the equipment shown in a position to be towed by a towing vehicle, the outriggers (which will then be in a folded position) being omitted for the sake of clarity;

FIG. 4 is a side elevational view of the equipment shown in an intermediate position ready for jacking up, the outriggers again being omitted;

BEST MODE OF CARRYING OUT THE INVENTION

Figure 1:
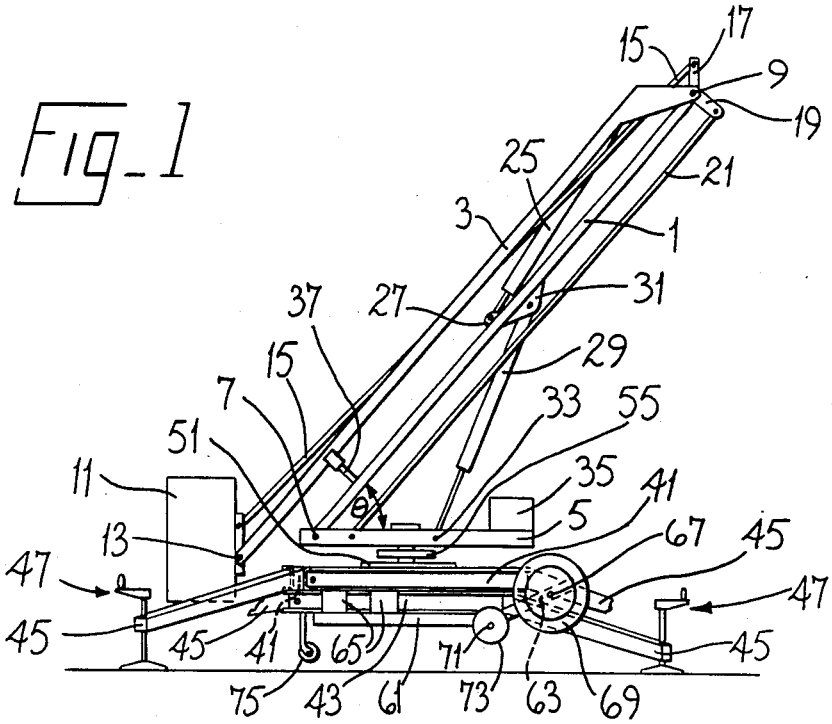
FIG. 1 is a side elevational view of the illustrative access equipment, the various components being shown somewhat schematically and not necessarily to scale, the equipment, with outriggers extended, being in a position jacked up ready for operation, with a boom arrangement in collapsed (rest) position.

The illustrative access equipment comprises a boom arrangement comprising a lower boom 1 (FIG. 1) and an upper boom 3, the lower boom being pivoted at one end portion of a support structure which includes a platform 5 by means of a first horizontal pivot 7 and, at its other, free, end portion, to a first end portion of the upper boom 3 by means of a second horizontal pivot 9. The other end portion of the upper boom is pivoted, by a third horizontal pivot 13, to a cage 11 providing a working platform of the access equipment.

In the use of the illustrative access equipment the cage is movable, in well known manner, into a wide variety of working positions as a consequence of pivotal movement imparted to the upper boom 3 about the pivot 9, and of pivotal movement imparted to the lower boom 1 about the pivot 7, such movements being effected respectively by first and second hydraulic rams 25 and 29, the former being connected between the upper boom 3 and a lug 27 on the lower boom 1, and the ram 29 being connected between a lug 31 on the lower boom 1 and the turntable platform 5 (by means of a pivot 33). For maintaining the orientation of the cage 11 (in a vertically disposed position) during movements of the booms 1 and 3 there is provided a linkage arrangement of known type, comprising a link 15 pivotally connected at opposite ends to the cage 11 and one arm 17 of a quadrant (itself pivoted about the pivot 9 interconnecting the booms 1 and 3), a second arm 19 of the quadrant being pivotally connected with a second link 21 which is pivotally connected, at its lower end, to the turntable platform 5. Power for the hydraulic rams is supplied by a power unit 35 supported adjacent an end portion of the platform 5 remote from the pivot 7.

The turntable platform 5 is rotatably mounted about a shaft 53 (FIG. 2) upstanding from a trolley portion of the equipment.

Figure 2:
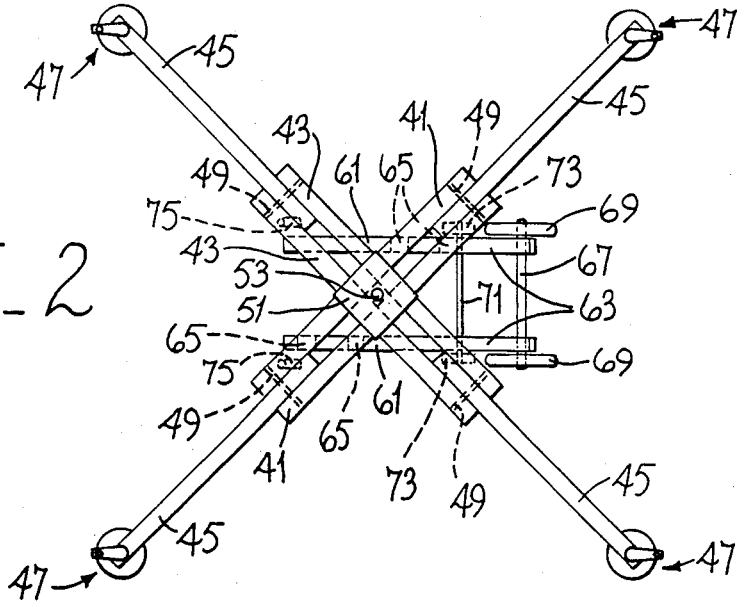
FIG. 2 is a plan view of a trolley portion of the equipment shown in FIG. 1.

The trolley portion comprises a frame which is X-shaped (as seen in plan, FIG. 2) made up from an upper pair of channel members 41 mounted back to back but in spaced relation (as seen in FIG. 2) and a similar pair of lower channel members 43 welded together to provide a rigid frame. A top plate 51 is welded to the upper channel members 41 and a similar plate (not shown) is welded beneath the lower channel members 43 to provide a support for the shaft 53 which is fixedly secured to the plates. Outrigger arms 45 are pivotally supported (by pivot pins 49) between the adjacent pairs of channel members 41, 43 (as shown in FIG. 2) and outer end portions of the arms are provided with jacks 47. The outrigger arms may be swung upwardly about the pivot pins 49 to stowed positions in which they may be secured by pin bolts, or pinned in their extended, operational positions.

A pair of chassis members 61 (disposed parallel to each other) are secured beneath the channel members 41 and 43 being connected directly to the members 43 and, by means of spacer blocks 65, to the members 41 (see FIGS. 1 and 2).

The chassis members 61 have upwardly inclined end portions 63 which provide bearings for an axle 67 on which are rotatably mounted a pair of road wheels 69, on which the equipment may be towed as hereinafter described. The chassis members 61 also provide supports for an auxiliary axle 71 on which are rotatably mounted a pair of auxiliary wheels 73, of smaller diameter than the road wheels 69 and spaced inwardly therefrom (i.e. between the wheels 69 and the axis of the shaft 53, as shown in FIGS. 1 and 2). Supported by the channel members 41 and 43 at locations remote from the wheels 69 and 73 is a pair of castor wheels 75 for a purpose which will shortly be described.

The rest position of the boom arrangement is as shown in FIG. 1, the lower boom 1 then being inclined at an angle $\theta$ to the horizontal. The upper boom 3 extends downwardly from the pivot 9 at least substantially parallel to the lower boom, bringing the cage 11 into a position close to the ground for easy access. The rest position of the lower boom is determined by the hydraulic ram 29, the ram being then in its fully instroked position. This limitation of the extent of lowering of the lower boom minimises the amount of control equipment required and, in particular, avoids the need to provide limit switches and associated interlocking arrangements to avoid the possibility of the booms moving into positions where the equipment would become unstable.

Figure 5:
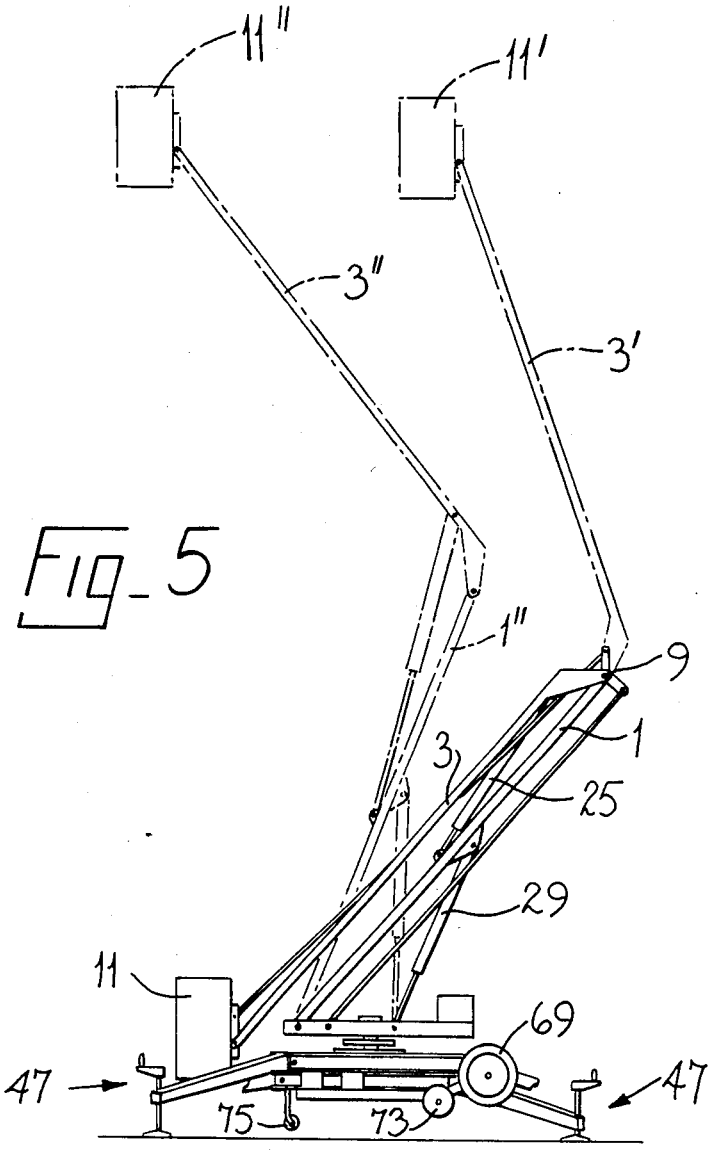
FIG. 5 is a side elevational view generally similar to FIG. 1 but indicating certain extended positions of the boom arrangement.

FIG. 5 shows the equipment in its rest position in fill lines (as in FIG. 1) but also indicates how (with the lower boom 1 maintained in its rest position) the upper boom can be raised (by extension of the hydraulic ram 25) to the position 3' indicated in the chain lines. Again it is the permitted stroke of the ram 25 which determines the maximum extension of the boom 3 without the need to provide limit switches and complex control gear. Extensions of the ram 29 swings the lower boom 1 about the pivot 7 to an extent limited by the permitted stroke of the arm. FIG. 5 shows (also in chain lines) the boom arrangement in a position (3″, 1″) approaching the maximum forward reach of the cage in the fully extended position of the boom 3 with respect to the boom 1.

When it is desired to move the equipment to another site, the boom arrangement is lowered to the rest position shown in FIG. 1, in which the upper boom rests against a rest 37 supported by the lower boom 1, the jacks 47 are then operated to lower the equipment on to the castor wheels 75 and auxiliary wheels 73 (as shown in FIG. 4) with the jack pads clear of the ground. For the sake of clarity, the outrigger arms and jacks are omitted from FIG. 4. It is to be understood that the arms and jacks are so arranged that, if the equipment is to be moved only a short distance, over a relatively smooth ground surface, to a new working position, it can be moved on the wheels 75 and 73 without the outrigger arms being first moved to their inoperative positions, the operator moving the equipment by (for example) manhandling it by means of the lower boom 1. If, however, the equipment is to be moved some distance, the outrigger arms 45 will be swung upwards to their inoperative positions (not shown) in which they will be pinned, and the equipment can then be tilted (by the operator pulling down on the lower boom 1) about the auxiliary wheels 73 until the equipment rests on the wheels 73 and the road wheels 69. The equipment can then be manhandled to its new working position to be hitched to a towing vehicle. The operator will then, by pulling down on the lower boom 1, swing the equipment, clockwise, into the towing position shown in FIG. 3 and hitch it up to the towing vehicle, e.g. by means of a suitable towing hook (not shown) provided on the lower boom 1. When the equipment arrives at the new site, it is unhitched from the towing vehicle and tilted (by the operator pushing upwards on the lower boom) about the road wheels 69 until the auxiliary wheels 73 contact the ground. The equipment can then be moved to its exact working position (on the wheels 69, 73 as above described) and may then be further tilted (about the wheels 73) until the castors 75 contact the ground. Jacking of the equipment may then be effected to level up the equipment to operative position as shown in FIG. 1.

With a view to providing a relatively inexpensive and easily handled and operated equipment suitable for use by Do-it-yourself handimen and the like, and easily towable by a domestic car, simple construction techniques are employed (e.g. by the use of channel members welded together) and the overall size is kept relatively small, but still allowing an operator in the cage 11 to be moved to a wide range of operating positions as will be seen from FIG. 5. From what has been said above the equipment can be fairly readily manoeuvered into confined spaces and, by providing alternative operative positions in which the outrigger arms may be pinned (e.g. in a near vertical position) the jacks (or some of them) may be caused to engage a vertical wall (or walls). Furthermore a plurality of inclined positions of the outrigger arms may be provided to facilitate the levelling up of the equipment on sloping ground.

Without imposing any particular limits on the dimensions, inclinations, or operative strokes of components of the illustrative equipment it may be mentioned, by way of example only, that the lower boom 1 may conveniently be of the order of from about 2.75 to 3 meters long and the upper boom correspondingly somewhat longer as seen in the drawings. A suitable offset between the upper and lower booms when in their rest position may conveniently be of the order of 0.25 m. The turntable platform may conveniently be of the order of 0.5 m in length with the power unit supported by an outwardly extending bracket at one end. The hydraulic ram 29 may conveniently be connected to the turntable platform at a distance of the order of 0.4 m from the pivot 7, and may have a closed length of some 670 mm and a stroke of some 85–90 mm. Similarly the ram 25 may conveniently have a closed length of some 880 mm and a stroke of some 675 mm. With suitable connecting points of the rams the equipment may then be moved through approximately the extents indicated in FIG. 5, the rest position of the lower boom 1 being at an angle $\theta$ within the range of approximately 45° to 55°, preferably approximately 50/52° to the horizontal. As hereinbefore mentioned, because of limitations placed on the position of the booms by the ram equipment and constructional dimensions, the control gear can be kept very simple without the need for provision of limit switches and associated safety circuits to avoid the booms moving into positions in which the equipment would become unstable. The rams may be operated by simple control levers or the like provided at the cage (or at the power unit).

Figure 6:
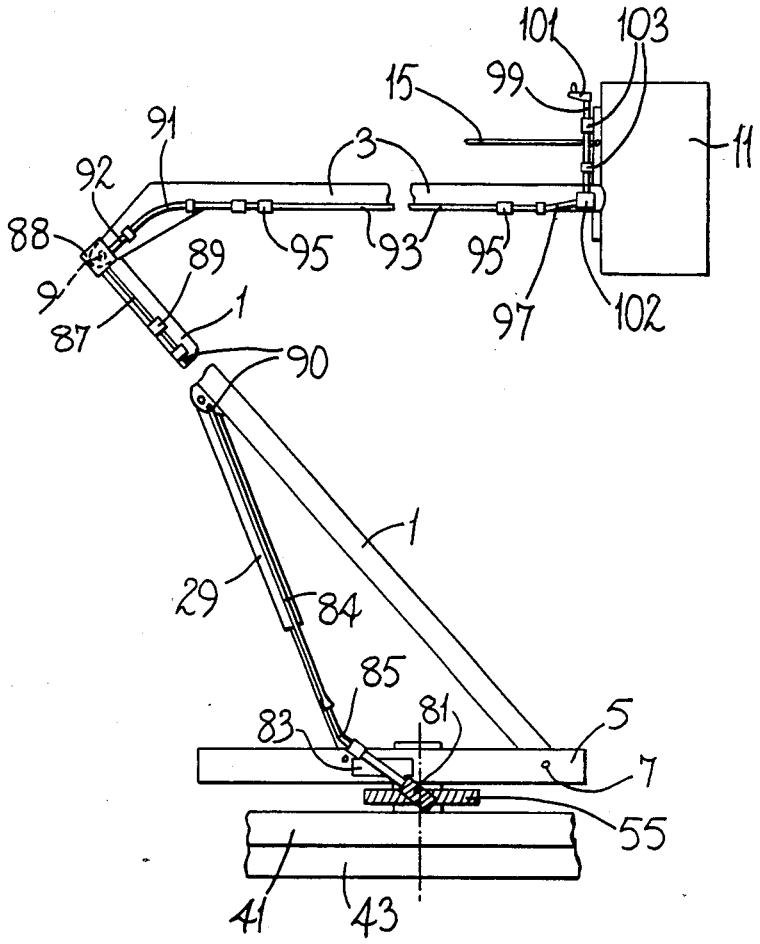
FIG. 6 is a side elevational view, with parts broken away showing, somewhat schematically, a hand-operated slewing gear with which the illustrative access equipment is provided.

A simple manually operated slewing control may be provided along the lines indicated, somewhat schematically, in FIG. 6. A helical gear wheel 55 is secured to the trolley portion of the equipment (being secured on the upstanding shaft 53) and is engaged by a worm 81 on a shaft rotatably mounted in a bearing bracket 83 secured at one side of the turntable platform 5 at a location fairly close to the pivotal connection with the ram 29. Lying parallel with the ram 29 (and supported in suitable bearings, not shown, mounted thereon) is a telescopic shaft arrangement 84, a lower end portion of which is connected by a flexible drive 85 with the worm shaft. An upper end portion of the telescopic shaft arrangement is connected, by means of a second flexible drive 90, with a rigid shaft 87 rotatably mounted in bearings 89 secured to the lower boom 1 and connected to one bevel of a bevel gear arrangement 88 mounted on the pivot 9 connecting the upper and lower booms. A second bevel of the bevel gear arrangement has a shaft 92 connected, by a third flexible drive 91, to a second rigid shaft 93 rotatable in bearings 95 supported by the upper boom 1. A hand wheel 101 is fixed to an upper end portion of a shaft 99 rotatable in bearings 103 supported by the cage 11, a lower end of the shaft being connected to one bevel gear arrangement 102 pivotally mounted about the pivot 13 for the cage. A second bevel gear of the gear arrangement 102 is connected, by another flexible drive 97, to the shaft 93. The rigid shafts 99, 93 and 87 may comprise readily available metal tubes or pipes and the flexible drives may comprise lengths of reinforced rubber hose of suitable construction. These are all relatively inexpensive components. The use of the telescopic shaft and the bevel gear arrangements avoids the need to use long lengths of flexible drive with the possibility of knotting. However, it may be possible by suitable choice of material to employ longer flexible drives without the need to use the bevel gear arrangements. An alternative form of slewing drive may comprise an electric motor for driving the shaft for the worm 81, the motor being controlled by control means provided at the cage, thus dispensing with the mechanical drive system just above described.

Furthermore, without departing from the spirit of the invention, the trolley portion may be modified, by the replacement of the jockey wheels 75 and the auxiliary wheels 73 with a single pair of auxiliary wheels suitably located along the length of the trolley portion, in which case on arrival on site, the operator will, by pushing upwardly on the lower boom, tilt the equipment about the road wheels from its towing position directly to jacking position (in which it rests on the road wheels and the auxiliary wheels).

I claim:

1. Access equipment towable by means of a prime mover and consisting of a supporting structure for mounting an articulated boom arrangement, the supporting structure including the combination of:

a. a turntable platform, b. a trolley, c. a shaft for spacing the turntable platform upwardly of the trolley and upon which the turntable platform is rotatable about said shaft relative to the trolley, d. a plurality of retractable outrigger arms each selectively movable relative to the trolley between a stored position and an outwardly-extended position, and e. a leveling jack mounted on the outboard end of each outrigger arm, and the boom arrangement including:

a. an operator's platform, b. an upper boom having opposite first and second termini and pivotally supporting the operator's platform at the first terminus, c. a lower boom having opposite first and second termini and pivoted at the first terminus to the turntable platform and at the second terminus to the second terminus of the upper boom, d. a first powered ram movable between instroked and outstroked positions for driving and determining the extension of the upper boom about its pivotal connection with the lower boom, and e. a second powered ram movable between instroked and outstroked positions for driving and determining the selection of the lower boom about its pivotal connection with the turntable platform, and wherein a pair of road wheels is carried by the trolley and the access equipment is so adapted and arranged that the equipment may be towed on said road wheels with the lower boom in a generally horizontal orientation and with the trolley inclined to said lower boom at an acute angle determined by the instroked position of the second powered ram and wherein a pair of auxiliary wheels is also carried by the trolley spaced from the road wheels along the trolley and on to which auxiliary wheels together with said road wheels the access equipment may be brought to rest by a weight shifting movement about said road wheels prior to jacking, the trolley in said rest position of said access equipment being in a less steeply inclined orientation relative to the horizontal and the lower boom being inclined to said trolley at said acute angle.

2. Access equipment according to claim 1 wherein, for effecting slewing movements of the turntable platform, a worm is provided rotatably mounted on the turntable platform and meshing with a helical gear secured to the trolley, rotation of the worm being effected from the cage under remote control.

3. Access equipment according to claim 1 wherein, for effecting slewing movements of the turntable platform, a worm is provided rotatably mounted on the turntable platform and meshing with a helical gear secured to the trolley, the worm being driven from the cage through a system of shafts rotatably mounted on the booms and interconnected by means including flexible and telescopic drives.

4. Access equipment according to claim 3 wherein the trolley comprises a frame which is X-shaped as seen in plan made up from an upper pair of channel members mounted back to back but in spaced relation and a similar pair of lower channel members welded together, the outrigger arms for the jacks being pivotally supported by pivot pins between adjacent pairs of the channel members.

* * * * *

UNITED STATES PATENT AND TRADEMARK OFFICE

CERTIFICATE OF CORRECTION

PATENT NO. : 4,569,416

DATED : February 11, 1986

INVENTOR(S) : Ridley Stokoe

It is certified that error appears in the above—identified patent and that said Letters Patent is hereby corrected as shown below:

In item [57] ABSTRACT, on line 4 after "platform" insert -- rotatable with respect to a trolley portion, has a first ram for moving the upper --

Signed and Sealed this

*Ninth* Day of *September 1986*

[SEAL]

*Attest:*

DONALD J. QUIGG

*Attesting Officer*

*Commissioner of Patents and Trademarks*